United States Patent [19]

Duerr

[11] 4,172,348

[45] Oct. 30, 1979

[54] PACKAGE AND APPARATUS AND METHOD FOR MAKING SAME

[75] Inventor: Joseph W. Duerr, Rockleigh, N.J.

[73] Assignee: Ganz Brothers, Inc., Bergenfield, N.J.

[21] Appl. No.: 898,455

[22] Filed: Apr. 20, 1978

[51] Int. Cl.[2] ..... B65B 53/02; B65B 61/10

[52] U.S. Cl. ..... 53/398; 53/411; 53/442; 53/492; 53/381 R

[58] Field of Search ..... 53/396, 398, 411, 412, 53/442, 492, 557, 131, 381 R, 393; 214/305

[56] References Cited

U.S. PATENT DOCUMENTS

| | | | |
|---|---|---|---|
| 3,687,282 | 8/1972 | Owen | 53/442 X |
| 3,889,442 | 6/1975 | Grahn et al. | 53/492 |
| 4,050,216 | 9/1977 | Stenberg | 53/413 |
| 4,050,223 | 9/1977 | Steeg et al. | 53/381 R |
| 4,121,401 | 10/1978 | Duerr et al. | 53/398 |

*Primary Examiner*—Travis S. McGehee

*Attorney, Agent, or Firm*—Charles E. Brown

[57] ABSTRACT

This disclosure relates to a method and apparatus for altering a package of containers encased by heat shrunk packaging material without structurally damaging the package. The package is modified in areas immediate of each container to expose a portion of each container for the affixing of a price mark thereupon, while providing sufficient structural strength to facilitate shipping of the package.

6 Claims, 6 Drawing Figures

PACKAGE AND APPARATUS AND METHOD FOR MAKING SAME

This invention relates to a new package for shipping articles. The package has been modified to expose a portion of each article after and while the articles have been encased within a heat shrunk wrapping, and without structurally damaging the package to facilitate shipping thereof.

In the past, articles have been shipped from a distributor in varying lots to a retailer for sale to the public. Each retailer requires a different amount of articles, and not necessarily always the same amount. The distributor usually packages the articles within boxes. The boxes have proven to be rather costly to make and rather limited in the number of articles which can be carried therein. It has been found that it is less costly to encase a plurality of articles with plastic packaging material which has heat shrinkable characteristics. The plastic material is rather inexpensive and may be quickly adapted to encase a predetermined number of articles to be shipped to the retailer.

Although heat shrink wrapped packages are more economical for shipping, they present certain problems for the retailer. Upon the receipt of a shipment of plastic encased articles, the retailer is faced with the problem of price marking the individual articles and placing them up the shelf with a minimal amount of cost.

The package must be opened to free the individual articles in order that a price mark may be placed upon each article. Once the articles have been removed from the confines of the package, each article is free to move and requires manual manipulation in order to properly affix a price thereto. This necessitates a stock clerk to carry the package of articles out into the isles of the store before opening each package and to hand mark each article while providing support thereto with the other hand.

Therefore, it is an object of this invention to provide a new method of, an apparatus for, and the resulting new article. The new article has structural strength to support a group of articles removed to expose a portion of each article to facilitate the affixing of a price mark to an article confined within the package.

Another object of this invention is the reduction of production costs which are passed on to the consumer by producing a package requiring a thinner shell of packaging material while permiting each article contained therein to be price marked without undue handling costs at the retailer.

With the above and other objects in view that will hereinafter appear, the nature of the invention will be more clearly understood by reference to the following detailed description, the appended claims and the several views illustrated in the accompanying drawings.

IN THE DRAWINGS

Figures 1, 2, 3, 4, 5, 6:
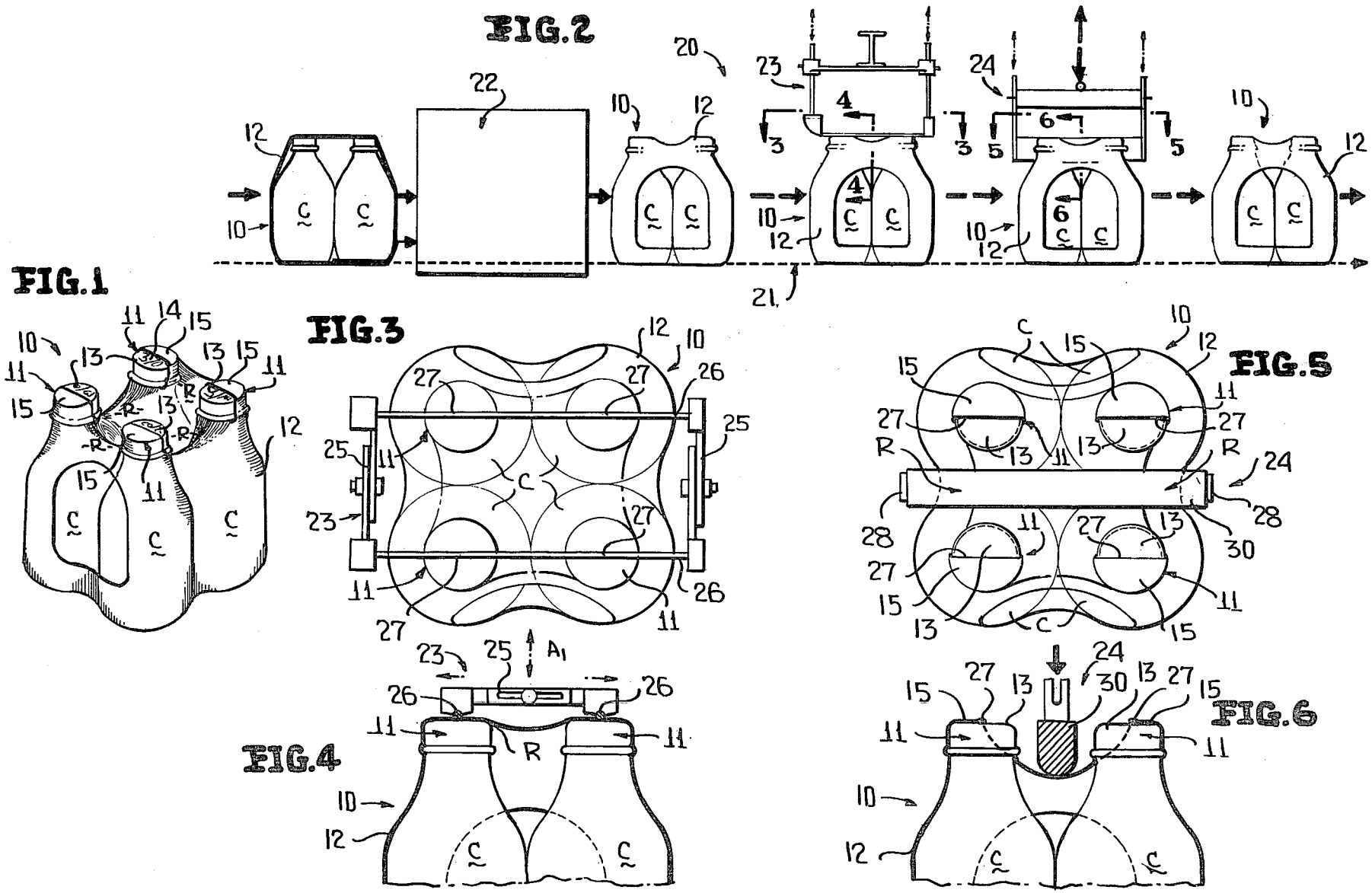
FIG. 1 is a perspective view of a new article made in accordance with this invention.
FIG. 2 is a diagrammatical view of the method and apparatus, and illustrates the steps for forming the new article of FIG. 1.
FIG. 3 is an enlarged horizontal sectional view of the invention taken along line 3—3 of FIG. 2, and illustrates the weakening unit.
FIG. 4 is an enlarged fragmentary vertical sectional view of the invention taken along line 4—4 of FIG. 2, and illustrates the positional relationship between the weakening unit and a package.
FIG. 5 is an enlarged horizontal sectional view of the invention taken along line 5—5 of FIG. 2, and illustrates the depressor unit.
FIG. 6 is an enlarged fragmentary vertical sectional view of the invention taken along line 6—6 of FIG. 2, and illustrates the positional relationship between the depressor unit and a package.

An embodiment of the new article made in accordance with this invention is illustrated in FIG. 1 in the form of a package, and is generally designated by the reference numeral 10.

The package 10 consists of a plurality of containers C each having a top closure 11. The containers C are arranged in column formation with each top closure 11 being spaced from an adjacent top closure by a recess R. The formation of containers C is encased by a packaging material 12. The packaging material 12 is constructed from plastic material which has heat shrinking characteristics. The packaging material 12 having been exposed to heat has shrunk to confine the containers to form initially a conventional shrunk film wrapped package.

The package 10 has been modified in such a manner that a portion 13 of each top closure 11 has been exposed to allow a price mark 14 to be affixed thereupon. The package 10 has been weakened in areas across each top closure 11 and the packaging material 12 has been drawn downward into a respective recess R to expose the respective portions 13 in a manner which will be described in more detail hereinafter. It should be quite apparent that the package 10 has structural strength to support the weight of the containers C, due to the remaining packaging material 12 which encases the remaining portion 15 of each top closure 11 to provide a structurally strong package.

In FIG. 2 there is illustrated a diagrammatic view of the method and apparatus utilized in forming the package 10 of FIG. 1. The apparatus is made in accordance with this invention, and is generally designated by the reference numeral 20.

The apparatus 20 includes a conveyor system or means 21 along which a plurality of containers C are moved as a group arranged in a column formation similar to that described in FIG. 1. The containers C are encased by a packaging material 12 and conveyed through a shrink tunnel 22 to effect shrinking of the packaging material 12. The group of containers C encased by the packaging material 12 is advanced from the shrink tunnel 22 as a package 10 similar to the package described in FIG. 1, but without the novel modifications.

The package 10 is then advanced along the conveyor system 21 and brought into alignment with a heating unit or means 23. The heating unit 23 is adjustably positioned above the conveyor system 21 to engage the packaging material 12 in areas across each container's top closure and effects weakening of the packaging material 16 in the areas.

The package 10 with the weakened areas formed therein is advanced to a depressor unit or means 24. The depressor unit 24 is mounted for vertical reciprocal movement relative to the conveyor system 21. Downward movement of the depressor unit 24 draws the packaging material 12 into a respective recess R and effectively draws the packaging material 12 from the weakened areas to expose a portion of each container top closure for price marking.

In referring to FIGS. 3 through 6, the actual operation of the apparatus 20 with respect to the heating unit 23 and depressor unit 24 will be discussed in greater detail.

In FIGS. 3 and 4 there is illustrated the heating unit 23 and its positioning relative to the package 10 to substantially effect the weakening of the packaging material 12. The heating unit 23 has a mounting structure or means 25 which supports two wire elements 26 in parallel relationship to the conveyor system 21. Each wire element 26 is positioned by the mounting structure 25 to communicate with each container C generally in the central area of each respective top closure 11. The wire elements 26 engage the packaging material 12 in areas immediate of each top closure 11 to weaken a portion of the packaging material 12.

The heating unit 23 is vertically adjustable as indicated by arrow $A_1$. The vertical adjustment is provided to permit the accommodation of containers C of different heights. The wire elements 26 are brought into engagement with the packaging material 12 adjacent the respective top closures 11 in such a manner that only the packaging material 12 is affected, the wire elements 26 being heated to form weakened areas 27.

Referring to FIGS. 5 and 6, there is illustrated in greater detail the depressor unit 24. The depressor unit 24 is mounted by mounting structure or means 28 for reciprocal vertical movement relative to the conveyor system 21. Downward vertical movement of the depressor unit 24 brings a depressor bar 30 into contact with the packaging material 12 in the area of a respective recess R. As the depressor bar 30 progresses downward, the weakened packaging material 12 in the areas 27 is pulled down into the recess R to expose a portion 13 of each top closure 11, allowing a respective portion 13 to remain in confining engagement with a respective closure 11.

The package 10 is advanced from the depressor unit 24 as the new package which has been described in FIG. 1. The package 10 has sufficient structural strength to permit carrying of the containers in package form, and allow the affixing of a price mark to individual containers while in the package.

Although only a 2×2 package is illustrated, it should be noted that other package combinations, such as a 1×3 and 2×3, etc., may be used without deviating from the novel concept of the invention. The containers must be orderly arranged to have a recess of sufficient width and depth to permit passage of a depressor bar to facilitate removal of the weakened areas.

Further, it is to be understood that the heating and depressor units may be used as a separate apparatus to modify packages stored at a warehouse or may be used in combination with a packaging machine without departing from the spirit and scope of the invention as defined by the appended claims.

I claim:

1. An apparatus for altering a package without structurally damaging the package wherein the package contains a plurality of containers encased in a wrap, said containers each having a top portion and each top portion is spaced from an adjacent top portion by a recess disposed therebetween, said apparatus comprising a package conveyor, weakening means lying above said package conveyor and in spaced proximity to effect the weakening of the wrap in an area immediate of each top portion, and depressor means positioned generally parallel to the direction of movement of said package conveyor and engagable with the wrap overlying the recess between respective adjacent container top portions for effectively drawing the weakened area of said wrap overlying respective adjacent top portions down into said recess and exposing an upper part of said respective top portions.

2. The apparatus of claim 1 wherein said depressor means is a member having at least one bar means for contacting the wrap, and means mounting said depressor means for reciprocal vertical movement relative to said package conveyor to facilitate the exposure of respective parts of said top portions by drawing respective weakened areas down into a respective recess by downward movement of said one bar.

3. The apparatus of claim 1 wherein said weakening means is a hot melt unit having at least one wire element, said one wire element extends generally parallel with said package conveyor and in alignment with respective top portions of a package, and said depressor means has at least one depressor surface positioned at an off-set relative to said one wire element and in alignment with a respective recess of a package.

4. A method of altering a package to expose the contents for marking without structurally damaging the package wherein said package has a plurality of containers confined within a packaging material and each container has a top portion arranged in spaced relation to an adjacent top portion to form a recess therebetween, said method comprising the steps of weakening the packaging material in an area across the top of each top portion, and depressing the packaging into the recess lying between adjacent top portions to effectively draw the weakened packaging material from the respective top portions thereby exposing a top part of each respective top portion.

5. The method of claim 4 wherein said method includes the steps of packaging a group of articles arranged in rows and columns by confining the group with packaging material, and cooling the packaging material before the step of weakening the packaging material.

6. The method of claim 4 wherein during the steps of weakening and depressing the package is being conveyed by a conveyor along a predetermined path, and said weakening and depressing is effected from above said path.

* * * * *